United States Patent [19]

Nichols

[11] 4,015,514

[45] Apr. 5, 1977

[54] APPARATUS FOR MAKING CIGARETTE FILTERS

[75] Inventor: Walter A. Nichols, Richmond, Va.

[73] Assignee: Philip Morris Incorporated, New York, N.Y.

[22] Filed: Jan. 29, 1976

[21] Appl. No.: 653,467

[52] U.S. Cl. ..... 93/1 C

[51] Int. Cl.[2] ..... A24C 5/50

[58] Field of Search ..... 93/1 C, 77 FT; 131/264, 131/265, 266, 261 R

[56] References Cited

UNITED STATES PATENTS

| | | | |
|---|---|---|---|
| 3,312,151 | 4/1967 | Molins | 93/1 C |
| 3,482,488 | 12/1969 | Sexstone | 93/1 C |
| 3,762,281 | 10/1973 | Burrus et al. | 93/1 C |

*Primary Examiner*—James F. Coan

*Attorney, Agent, or Firm*—Watson Leavenworth Kelton & Taggart

[57] ABSTRACT

Apparatus for feeding low density particulate material into spaces between filter plugs secured spacedly to filter wrap provides for fluidizing the material and transferring the fluidized material by suction into such spaces. The filter plugs and wrap are conveyed through a passage whose sidewall preferably is provided in part by an elongate generally continuous concave surface of a unitary housing having conduits extending therethrough from longitudinally spaced openings in the concave surface.

15 Claims, 4 Drawing Figures

APPARATUS FOR MAKING CIGARETTE FILTERS

FIELD OF THE INVENTION

This invention relates to apparatus for the feeding of particulate material into spaces between filter plugs attached to a continuous filter wrap to provide plug-filler-plug filters for cigarettes.

BACKGROUND OF THE INVENTION

Burrus et al. U.S. Pat. No. 3,762,281 discloses a type of apparatus for feeding particulate material, for example, activated carbon, from a hopper to provide plug-filler-plug cigarette filters. In such Burrus et al. apparatus an entrance passage of generally circular cross-section is defined by interfitting bottom and top members such that filter wrap may be conformed to partially encircling arrangement with filter plugs spacedly longitudinally secured to the wrap with the remaining peripheries of the plugs and spaces therebetween being enclosed by the upper wall of the entry passage. Such upper entry passage wall, provided by the top member, includes openings and ducts extending therefrom whereby suction pressure may be provided within the entry passage to assist the feeding of material into the spaces between plugs beyond the end of the entry passage, i.e., disposed in a feed station.

In the apparatus feed station, the top member defines a slot of extended longitudinal travel, exposing a succession of plugs and spaces to the discharge outlet of a hopper situated above the top member whereby the hopper contents are applied generally to such plugs and spaces to fill the spaces. Vibration is introduced in the feed station to further facilitate the feeding operation.

Beyond the feed station, the top member slot is terminated and the top passage wall is reconstituted by the top member to provide an exit passage enclosing the plugs and now-filled spaces. In such exit passage, the top member defines transverse grooves which function to trim excess material disposed atop the filter plugs and spaces. While this operation may be assisted by inclusion of a suction aperture within the exit passage, the exit passage nonetheless terminates with the wrap issuing from the top member in open relation to the plugs and filled spaces and a further station is then provided exteriorly of the top member at which station a separate suction device removes material remaining outside the spaces and otherwise interiorly of the wrap. Other structural aspects of this type of apparatus are considered in Burrus et al. U.S. Pat. Nos. 3,772,967 and 3,812,768.

While the foregoing apparatus is suitable for use in feeding free-flowing particulate material, it is not considered to be effective for the feeding of more finely-divided solids, particularly low density materials, such as microporous polyethylene. The latter materials tend to bridge, i.e., agglomerate, even in cavities, openings and passages of relatively wide dimensions. Thus, the aforementioned transverse grooves of the Burrus et al. apparatus are readily clogged by such low density material and thus rendered ineffective to further trim excess material. Further, the introduction of vibration may undesirably result in compacting bridges and hence undesirably reinforcing them.

SUMMARY OF THE INVENTION

The present invention has as its principal object the provision of apparatus for effectively feeding finely-divided solids in the manufacture of plug-filler-plug cigarette filters.

In attaining this and other objects, the invention provides apparatus wherein hopper-contained material is fluidized prior to being drawn by suction into a passage in the apparatus for transport of filter wrap therethrough. The passage, generally continuous between entry and exit ports thereof, has its encircling wall provided in part by a unitary housing having an elongate projection, a concave surface of which includes openings at first, second and third longitudinally successive locations for negatively pressurizing the passage in the vicinities of such first and third locations and for permitting entry of material in the passage at the second location. Preferably, the concave surface is generally smooth throughout its longitudinal extent and the opening therein at such second location is of longitudinal extent approximating that of a space between successive plugs.

Apparatus according with the invention as discussed below is effective for the feeding of finely-divided solids, with materials such as microporous polyethylene, where vibration cannot be used and without need for a device situated exteriorly of the referenced passage for removing excess material.

The foregoing and other objects and features of the invention will be evident from the following detailed description and from the drawings wherein like reference numerals identify like parts throughout.

DETAILED DESCRIPTION OF THE PREFERRED EMBODIMENT

Figure 1:
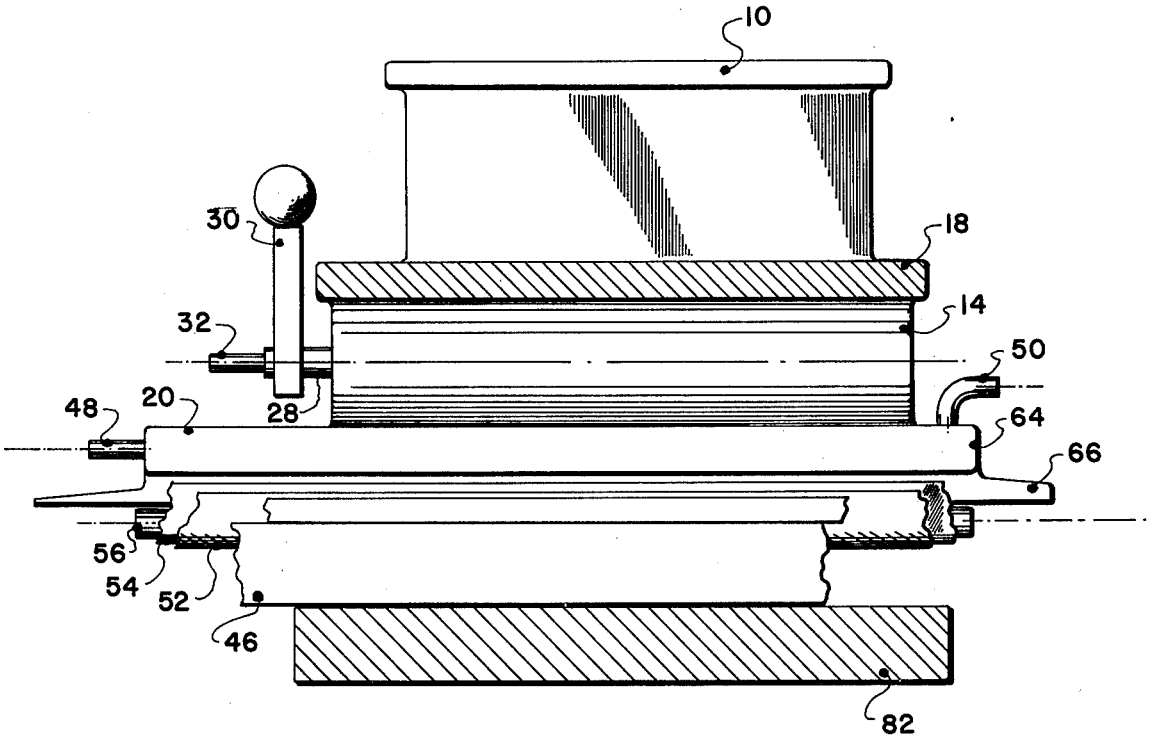
FIG. 1 is a side view of material feeding apparatus according with the invention, with its support bracket cut away to show detail.
Figure 2:
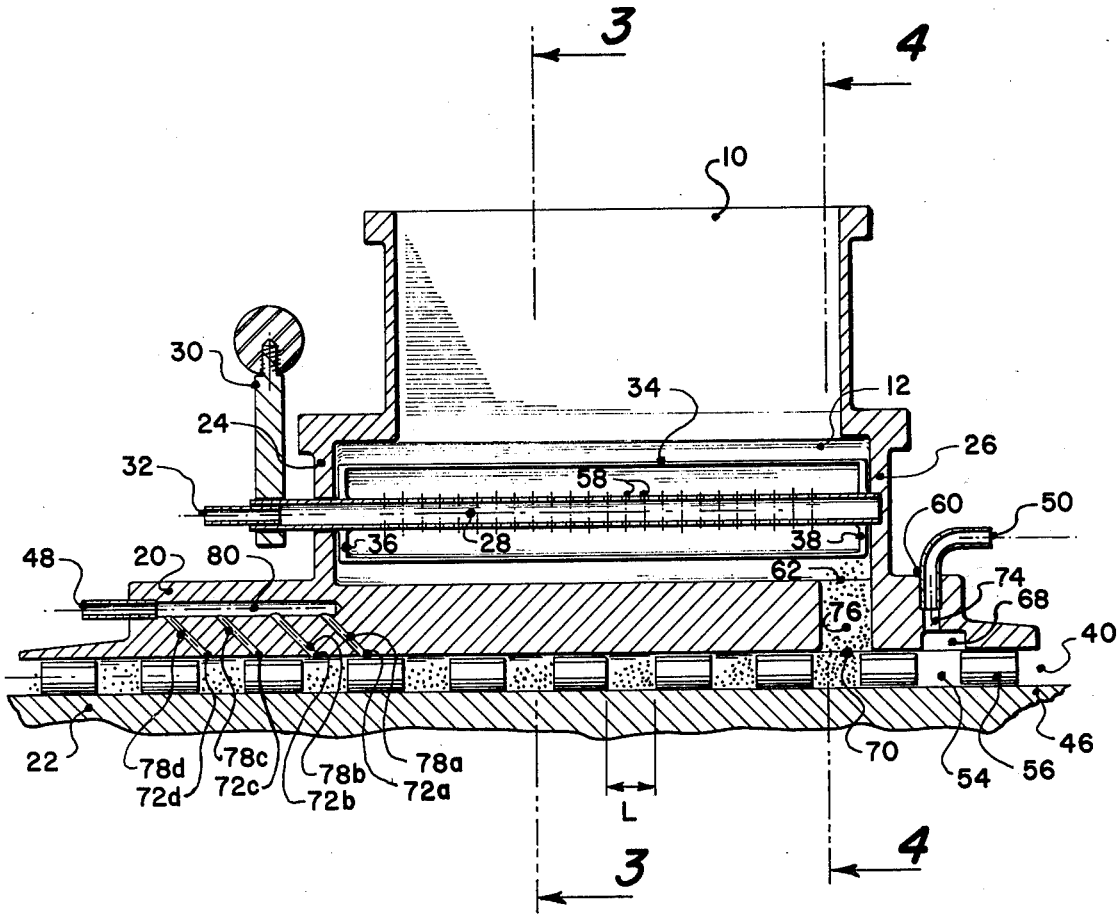
FIG. 2 is a side sectional view of the apparatus as seen from plane 2—2 of FIG. 3.

Referring to FIG. 1, the material feeding apparatus therein may include a feed tube provided with a suitable butterfly valve (not shown) operable to provide material flow into material storage hopper 10. As shown in FIG. 2, hopper 10 opens into chamber 12 which includes opposed arcuate sidewalls 14 and 16 (FIG. 3) extending from plate 18 to upper member 20 of material feed control unit 22. Chamber 12 is closed at opposed ends thereof by end walls 24 and 26 (FIG. 2), which support fluidizing tube 28. Tube 28 extends sealably outwardly through a central opening in end wall 24 where it is secured to handle 30, the tube being fed with pressurized gas through tube 32.

Closure plate 34 (FIGS. 2 and 3) is connected to tube 28 by brackets 36 and 38 and thereby supported at such distance from tube 28 as to be disposed adjacent the interior of the walls of chamber 12. Plate 34 is repositionable within chamber 12 by rotation of tube 28 by handle 30.

Feed control assembly 22 has an elongate passage 40 (FIG. 2) therethrough bounded by opposed generally semicircular surface 42 (FIG. 3) of upper member 20 and generally semicircular surface 44 of lower member 46 of assembly 22. Assembly 22 further has tubes 48 and 50 (FIG. 2) which are connected to vacuum pressure sources (not shown) for purposes discussed more particularly below. Material feed control assembly portions situated at leftward and rightward extremes thereof are adapted to suitably maintain garniture tape 52 and filter wrap 54 supported thereon in generally U-shaped configuration, i.e., whereby the filter wrap openly encircles filter plugs 56, secured to the filter wrap in longitudinally-spaced relation.

As is seen in FIG. 2, tube 28 is elongate with apertures 58 spaced longitudinally therealong and communicating with the interior hollow of the tube. The leftward end of tube 28 is open and is connected to tube 32 while the rightward end of the tube is closed. End walls 24 and 26 support tube 28 for rotation about its longitudinal axis.

Upper member 20 (FIG. 3) of feed control unit 22 provides a floor for chamber 12 and has first and second openings, 60 and 62. Opening 60 is disposed longitudinally rightward and opening 62 longitudinally leftward of chamber end wall 26. With such positioning of these openings, opening 62 serves as an outlet for chamber 12 and tube 50 may be placed in registry with opening 60 exteriorly of chamber 12. Member 20 includes a main body portion 64 and a downward projection 66, the latter having an exterior concave surface, identified above as surface 42, extending longitudinally with and providing a part of the enclosing wall of passage 40.

Surface 42, generally smooth throughout its longitudinal extent has first, second and third openings 68, 70 and 72*a–d*, at respective longitudinally successive locations in surface 42. The longitudinal spacing between openings 68 and 70 is at least equal to, and preferably approximates, length L of the space between successive of plugs 56.

First and second conduits 74 and 76 (FIGS. 2 and 4) extend respectively from openings 60 and 62 through projection 66 and main body portion 64 in like direction, providing communication to passage 40. Further conduits 78*a–d* extend from openings 72*a–d* through projection 66 and into main body portion 64 and conduit 80 therein which in turn communicates with tube 48.

Figure 3:
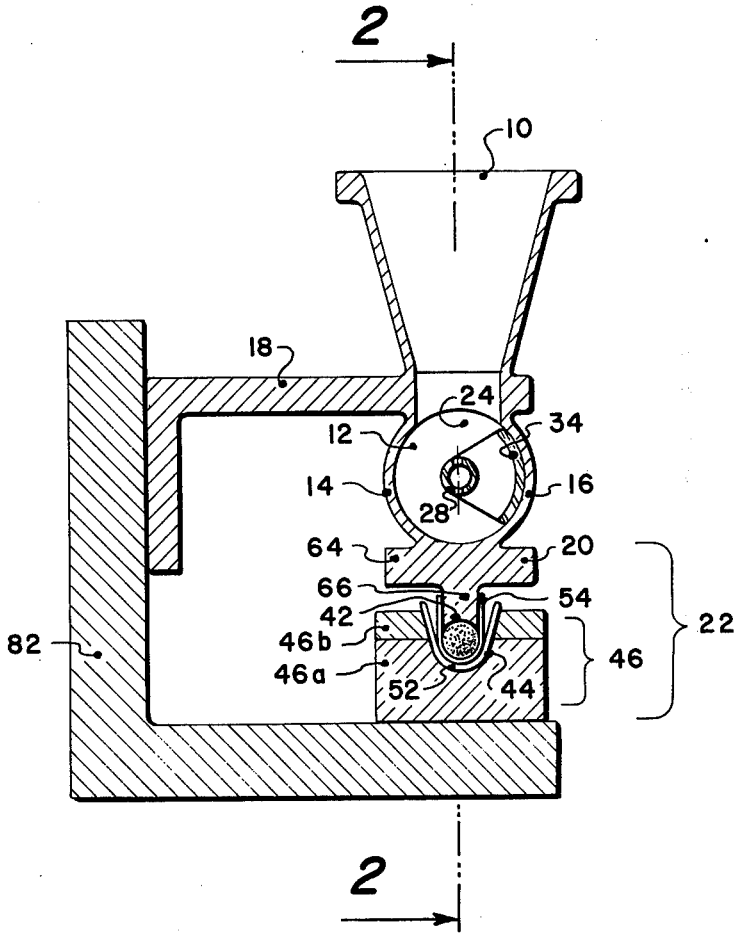
FIG. 3 is a sectional view as seen from the plane 3—3 of FIG. 2.

In operation of the described apparatus, and with garniture tape 52, wrap 54 and filter plugs 56 disposed therein as shown in FIG. 3, tube 32 is connected to a source of positively pressurized air such as to deliver 4 to 5 pounds per square inch of pressurized air through apertures 58, thereby fluidizing material in chamber 12. With tube 50 connected to a source of negatively pressurized air, for example, 25 inches of mercury, suction is exerted through the plug disposed between openings 68 and 70 in passage 40, thereby drawing fluidized material into passage 40 leftwardly of such plug and hence into the space immediately leftward of such plug. As noted above, a plug or portion thereof will always intervene openings 68 and 70 since they are longitudinally separated by at least the distance between successive plugs. Accordingly, direct resistance-free communication between openings 68 and 70 is precluded.

Where the longitudinal extent of opening 70 is substantially equal to the longitudinal distance L (FIG. 2) between successive plugs, as is preferred, disposition of fed material generally atop the plugs is minimized.

Filled spaces and plugs advancing leftwardly of opening 70 are enclosed in first peripheral portion by partially encircling wrap 54 and in the remainder of their peripheral expanse by close-fitting surface 42. Ultimately, the filled spaces and plugs pass under openings 72*a–d*, the width of which is less than that of the plugs. With tube 48 connected to a source of negatively pressurized air, for example, 0.3 to 0.6 inch of mercury, such that conduits 78*a–d* are pressurized negatively with respect to tube 28, but positively with respect to opening 68, a gentle suction occurs in the vicinity of openings 72*a–d* to remove material which may be disposed on plugs 56 without substantial removal of material from the filled spaces.

Preferable diameters for apertures 58 are from 0.070 to 0.090 inch, though a diameter range of from 0.050 to 0.125 inch is suitable. The apertures may be spaced along tube 28 at 0.250 inch intervals with the number of apertures being about 22 in a tube of approximately 8 inches length between end walls 36 and 38, end extents of the tube being unapertured as shown in FIG. 2.

On issuance of the filter wrap from passage 40, it is folded, sealed and cut in accordance with known procedures.

By rotation of handle 30 inwardly in FIG. 2 by one-quarter turn, closure plate 34 may be positioned to close opening 62 and thereby isolate chamber 12 from passage 40 during periods in which the apparatus is idle.

Figure 4:
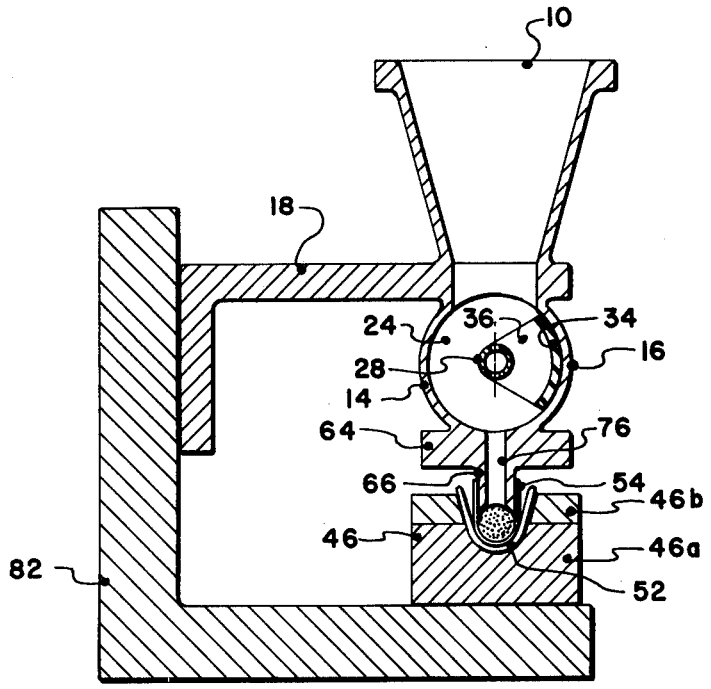
FIG. 4 is a sectional view as seen from the plane 4—4 of FIG. 2.

As shown in FIG. 4, support for plate 18 and member 46 may be furnished by bracket 82, with member 46 including part 46*a* secured to bracket 82 and part 46*b* atop part 46*a*.

Various changes may evidently be introduced in the foregoing apparatus without departing from the invention. Thus, the drawings and description of the foregoing preferred embodiment are intended in an illustrative and not in a limiting sense. The true spirit and scope of the invention is set forth in the following claims.

What is claimed is:

1. Apparatus for feeding particulate material into spaces between filter plugs secured to a continuous filter wrap comprising:

a. a hopper means for containing said material and having an outlet for discharging said material;

b. fluidizing means having an extent thereof supported in said hopper means in engagement with said material for issuing pressurized air through said material while said material is in said hopper means; and c. material feed control means having an elongate passage therethrough for conveying said filter wrap therethrough in partially encircling relation to said filter plugs and spaces, said material feed control means including a unitary housing part having first, second and third conduit means therein communicating with said passage at first, second and third locations respectively successively longitudinally disposed along said passage, said first location being longitudinally spaced from said second location by a distance not less than the longitudinal distance between successive of said filter plugs, said first conduit means being pressurized negatively with respect to said hopper means, said third conduit means being pressurized positively with respect to said first conduit means and negatively with respect to said hopper means, said second conduit means communicating further with said hopper means outlet.

2. The apparatus claimed in claim 1 wherein said fluidizing means comprises an elongate hollow tubular member centrally disposed in said hopper means and defining longitudinally spaced apertures for providing issuance of pressurized air therethrough into said hopper means.

3. The apparatus claimed in claim 1 wherein said unitary housing part includes an elongate projection having a concave exterior surface forming a portion of the encircling wall of said passage, said first, said second and said third locations being on said concave surface.

4. The apparatus claimed in claim 3 wherein said concave surface defines openings therein at said first, said second and said third locations.

5. The apparatus claimed in claim 4 wherein the longitudinal extent of said opening at said second concave surface location is substantially equal to the longitudinal extent of the space between successive of said filter plugs.

6. The apparatus claimed in claim 4 wherein said first, said second and said third conduit means extend respectively from said openings in said first, said second and said third concave surface locations through said unitary housing part projection, said openings being singular at said first and second locations and plural at said third location.

7. The apparatus claimed in claim 6 wherein said unitary housing part further includes a main body portion contiguous with said projection thereof, said first and said second conduit means each comprising a single conduit extending in like direction through said main body portion and said projection, said third conduit means comprising plural conduits extending separately from said plural openings at said third location through said projection and joined with a further common conduit disposed in said main body portion.

8. The apparatus claimed in claim 7 wherein said common conduit extends through said main body portion in a direction transversely of said direction in which said first and second conduit means extend.

9. The apparatus claimed in claim 3 wherein said concave surface is a smooth surface throughout all extent thereof excepting openings therein at said first, said second and said third locations.

10. The apparatus claimed in claim 9 wherein the longitudinal extent of said opening at said second concave surface location is substantially equal to the longitudinal extent of the space between successive of said filter plugs.

11. The apparatus claimed in claim 9 wherein said first, said second and said third conduit means extend respectively from said openings in said first, said second and said third concave surface locations through said unitary housing part projection, said openings being singular at said first and second locations and plural at said third location.

12. The apparatus claimed in claim 11 wherein said unitary housing part further includes a main body portion contiguous with said projection thereof, said first and said second conduit means each comprising a single conduit extending in like direction through said main body portion and said projection, said third conduit means comprising plural conduits extending separately from said plural openings at said third location through said projection and joined with a further common conduit disposed in said main body portion.

13. The apparatus claimed in claim 12 wherein said common conduit extends through said main body portion in a direction transversely of said direction in which said first and second conduit means extend.

14. The apparatus claimed in claim 1 further including closure means for closing said hopper means outlet.

15. The apparatus claimed in claim 14 wherein said fluidizing means comprises an elongate hollow tubular member centrally supported in said hopper means for rotation therein, said tubular member defining longitudinally spaced apertures for providing issuance of pressurized air therethrough into said hopper means, said closure means being secured to said tubular member for rotation therewith.

* * * * *